United States Patent [19]

Jackson et al.

[11] 4,202,488

[45] May 13, 1980

[54] PENDULUM SUSPENDED HYDRAULICALLY DRIVEN BASKET CENTRIFUGES

[75] Inventors: Joseph F. Jackson, Halifax; Edward M. Cooper, Huddersfield, both of England

[73] Assignee: Thomas Broadbent & Sons Limited, West Yorkshire, England

[21] Appl. No.: 917,755

[22] Filed: Jun. 21, 1978

[30] Foreign Application Priority Data

Jun. 30, 1977 [GB] United Kingdom ..... 27325/77

[51] Int. Cl.[2] ..... B04B 9/06

[52] U.S. Cl. ..... 233/24

[58] Field of Search ..... 233/1 R, 1 A, 7, 23 R, 233/24, 25, 26; 308/187; 91/485, 491, 492

[56] References Cited

U.S. PATENT DOCUMENTS

| | | | |
|---|---|---|---|
| 2,712,794 | 7/1955 | Humphreys | 91/485 |
| 3,126,338 | 3/1964 | Steinacker | 233/1 A |
| 3,527,402 | 8/1970 | Kobetsky | 233/1 A |
| 3,540,352 | 11/1970 | Parrett | 91/501 |
| 3,860,165 | 1/1975 | Fiedler | 233/24 X |
| 4,085,889 | 4/1978 | Steimel | 233/24 |

*Primary Examiner*—George H. Krizmanich

*Attorney, Agent, or Firm*—Beveridge, DeGrandi, Kline & Lunsford

[57] ABSTRACT

A pendulum suspended, hydraulically driven basket centrifuge comprises a centrifuge basket adapted to be rotated about a vertical axis by a hydraulic motor. The basket is mounted on the upper end of a vertically extending main spindle which is journalled within a cylindrical casing by means of two bearing assemblies disposed at upper and lower portions on the spindle, respectively. The hydraulic motor, the casing, the bearing assemblies and the main spindle are constructed as a cartridge unit which can be removed from the basket as a complete sub-assembly.

9 Claims, 4 Drawing Figures

PENDULUM SUSPENDED HYDRAULICALLY DRIVEN BASKET CENTRIFUGES

This application relates to basket centrifuges of the pendulum suspended, hydraulically driven type.

Conventional basket type centrifuges normally employ a hydraulic motor drive for the basket, particularly where the centrifuge is installed in a hazardous operating zone entailing explosion risk. In known arrangements, a self-contained hydraulic motor is generally mounted with its axis either coaxial or eccentric, but parallel to the centrifuge basket rotational axis. In the coaxial case the hydraulic motor output shaft is connected to the main spindle of the centrifuge by a flexible transmission coupling and in the eccentric case by a pulley and belt drive arrangement. The basket is rotatable by the motor about a vertical axes by way of a main spindle which supports the basket from below and is journalled in a cylindrical housing by way of upper and lower bearing assemblies, the latter housing, the upper and lower bearing assemblies and the main spindle together constituting a cartridge unit which can be produced as a complete sub-assembly.

In both the aforegoing arrangements, the hydraulic motor or belt drive tends to interfere with the discharge of solids, which takes place through the base region of the basket.

It is an objective of the present invention to provide an arrangement in which the latter disadvantage is substantially eliminated.

In accordance with the present invention, the hydraulic motor is incorporated in the cartridge unit so as to be coaxial with the main spindle.

Preferably, the rotor of the hydraulic motor is attached directly to the main spindle. Th motor housing can then be attached to the lower end of the cylindrical outer body of the cartridge unit.

Advantageously, the hydraulic motor inner chamber communicates with at least the lower of the bearing assemblies of the cartridge unit whereby at least this bearing is lubricated by hydraulic fluid from the motor. Both bearings can be so lubricated if desired.

The invention is described further hereinafter, by way of example, with reference to the accompanying drawings, in which.

Figure 1:
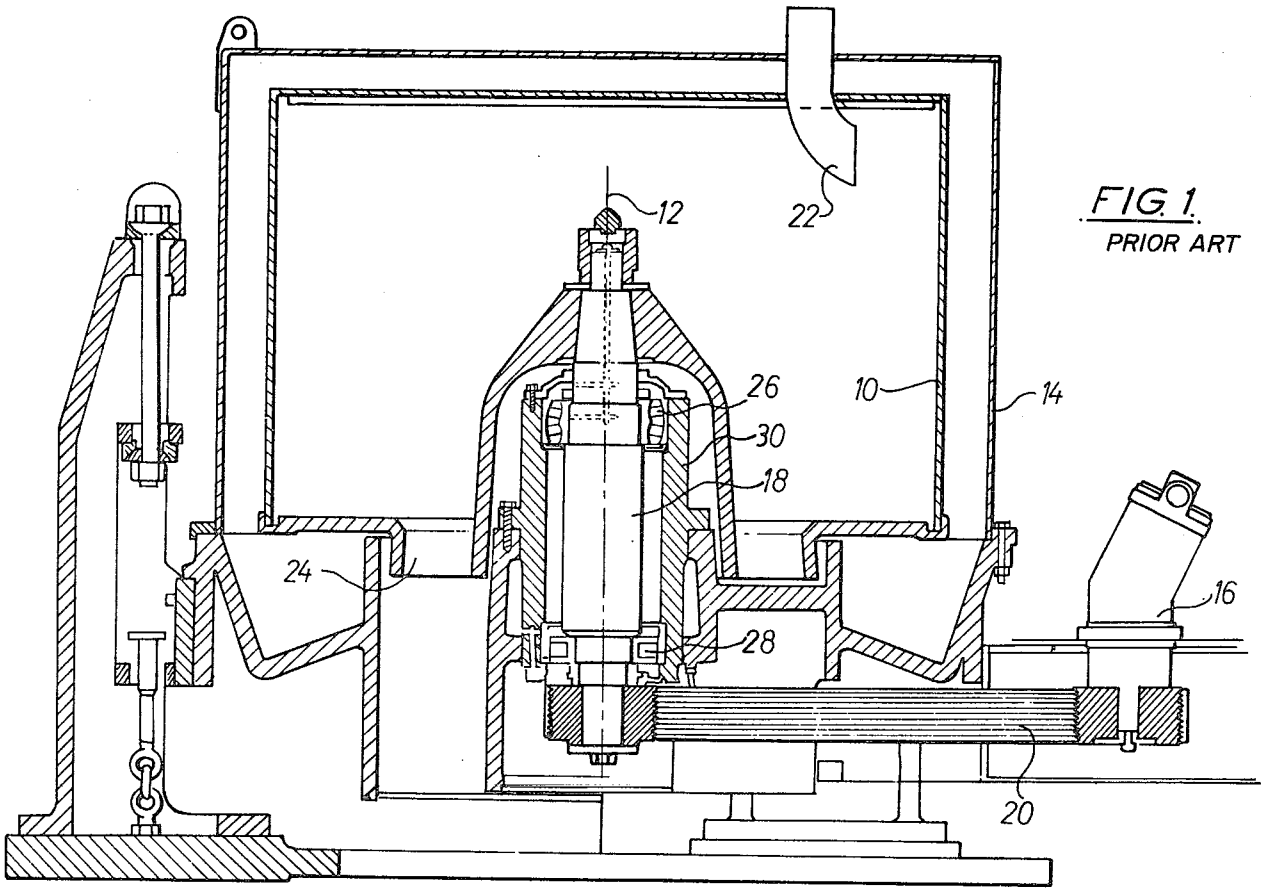
FIG. 1. PRIOR ART
FIG. 1 is a sectional view of a known pendulum suspended hydraulically driven basket centrifuge.

With reference to FIG. 1, the known centrifuge comprises a cylindrical centrifuge basket 10 which is rotatable about a vertical axis 12 within a cylindrical housing 14 by means of a hydraulic motor 16 coupled to the basket 10 by way of a main spindle 18 and a belt and pulley drive 20. The basket has an inlet pipe 22 and outlets 24. It will be noticed that the belt drive arrangement interferes somewhat with the basket outlets 24 in that it takes up a considerable part of the space around the base of the basket which could otherwise be used for discharging purposes. The main spindle 18 rotates in rolling bearings 26, 28 housed in an outer cylindrical body 30, these latter components together forming a cartridge unit which can be produced as a complete sub-assembly.

Figure 2:
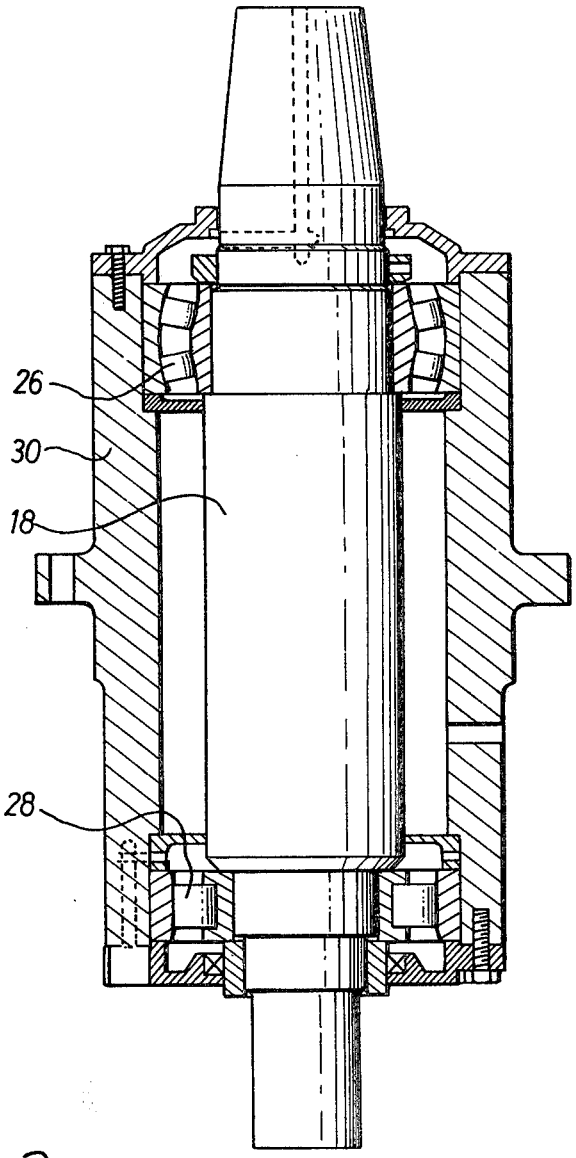
FIG. 2. PRIOR ART
FIG. 2 is a sectional view of one known cartridge unit for a centrifuge of the type illustrated in FIG. 1.
Figure 3:
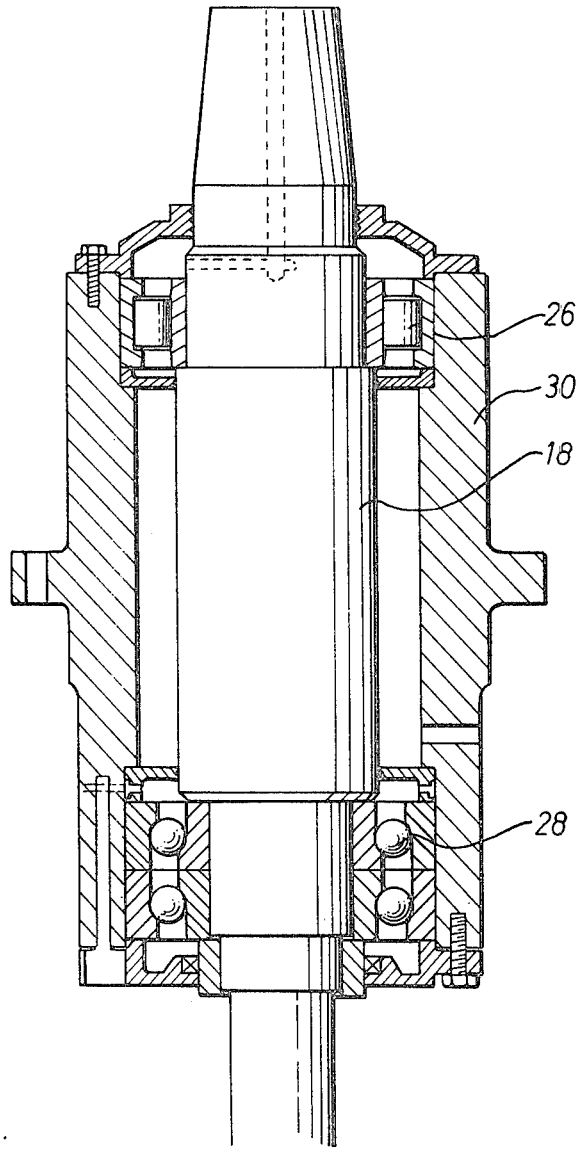
FIG. 3. PRIOR ART
FIG. 3 is a sectional view of a second known cartridge unit for a centrifuge of the type illustrated in FIG. 1.

The cartridge unit of FIG. 1 is shown again to a larger scale in FIG. 2. FIG. 3 shows another known embodiment of such a cartridge unit using modified bearing members.

Figure 4:
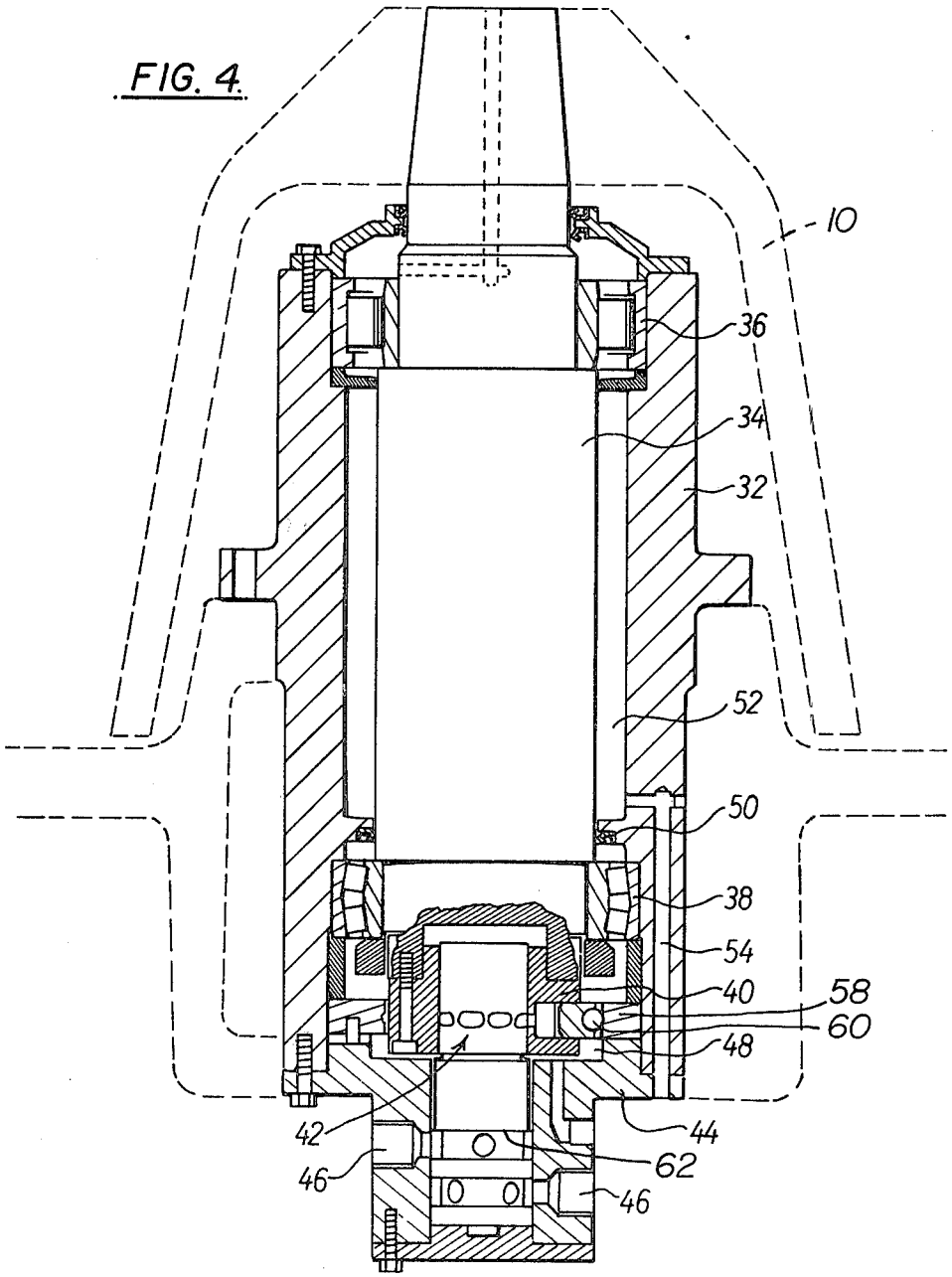
FIG. 4 is a sectional view of one embodiment of a cartridge unit for a centrifuge in accordance with the present invention.

FIG. 4 illustrates a modified cartridge unit embodying the invention, in which the hydraulic driving motor is incorporated as an integral part of the cartridge unit. This unit employs a cylindrical outer body 32 having a main spindle 34 journalled therein by upper and lower rolling bearings 36, 38. The lower end of the spindle 34 carries the rotor 40 of a coaxial hydraulic motor 42 whose housing 44 is bolted to the bottom end of the cylindrical outer body 32. The housing 44 has connection ports 46 for the supply and removal of hydraulic fluid for the motor. Although a hydraulic motor employed has a multi-lobed cam type stator 58, ball pistons 60 on the rotor 40, and selective connection of the piston chambers by a rotary pintle valve system, 62 any convenient type of hydraulic motor may be used in the cartridge unit.

As will be noted in FIG. 4, the hydraulic motor 42 utilises the main spindle bearings 36, 38 without requiring its own additional bearings and is carried outboard of the lower bearing 38. The latter feature allows for particular ease of access for servicing. The internal chamber 48 of the motor is separately drained and, in the illustrated embodiment, a rotary shaft seal 50 is introduced between the two main bearings 36, 38 such that the lower bearing 38 can be lubricated by hydraulic fluid from the motor. In other embodiments, both the upper and the lower bearings 36, 38 may be contained within the motor chamber and similarly lubricated by the motor hydraulic fluid.

The only potential leakage point is from the single rotary seal 50 between the upper and lower bearings. The chamber 52 above this seal 50 is drained to atmosphere via a passage 54 and any leakage fluid which should occur after a sustained period of running is collected and drained to a separate container (not shown) to eliminate any possible contamination of the product by hydraulic fluid.

Further advantages of the aforegoing arrangement relates to accessibility for service and maintenance work. In this respect, the spindle cartridge unit is readily removed complete with hydraulic motor for either service or alternatively the hydraulic motor parts may be easily removed from the bottom of the cartridge unit without disturbing the main bearings 36, 38. It will also be noted that the obstruction of the discharge area found in the known arrangements is substantially eliminated in the new arrangement.

We claim:

1. In a pendulum suspended, hydraulically driven basket centrifuge having a centrifuge basket, a main spindle, a cylindrical spindle casing, means journalling said main spindle for rotation within said spindle casing about a vertical axis, said means including at least two bearing assemblies disposed at upper and lower positions on said spindle, respectively, means mounting said basket on the upper end of said main spindle, and a hydraulic motor adapted to rotate said main spindle, and hence the basket, about said vertical axis, the improvement in which said hydraulic motor, said spindle casing, said bearing assemblies and said main spindle are constructed as a cartridge unit which can be removed from the basket as a complete sub-assembly, and in which a rotary seal is disposed between the spindle and the inner periphery of the cylindrical casing at a position between the upper and lower bearing assemblies, the annular chamber so formed between the rotary seal and the upper bearing assembly being drained to atmosphere.

2. A centrifuge according to claim 1 in which the rotor of the hydraulic motor is attached to said main spindle, the motor housing being attached to the lower end of said cylindrical casing.

3. A centrifuge according to claim 2 in which the hydraulic motor is carried outboard of the lower bearing assembly on the spindle, with no additional bearings provided for the motor.

4. A centrifuge according to claim 1, 2 or 3, in which the hydraulic motor has an inner working chamber which communicates with at least the lower of the bearing assemblies whereby at least the latter bearing assembly is lubricated by hydraulic fluid from the motor.

5. A centrifuge according to claim 1 in which the hydraulic motor is of the multi-lobed cam type stator and ball piston rotor construction, having selective connection of the piston chambers by a rotary pintle valve system.

6. A hydraulically driven basket centrifuge comprising a centrifuge basket, a main spindle which supports said basket from below, a hydraulic motor adapted to rotate said main spindle, and hence the basket, about a vertical axis, a cylindrical spindle casing, means journalling said main spindle for rotation within said spindle casing about a vertical axis, said means including at least two bearing assemblies disposed independently of said hydraulic motor at upper and lower positions on the spindle, respectively, means mounting said basket on the upper end of said main spindle, said hydraulic motor, said spindle casing, said bearing assemblies and said main spindle being constructed as a cartridge unit which can be removed as a complete sub-assembly, the hydraulic motor including a rotor which is disposed within a working chamber defined by said cylindrical spindle casing and which is rigidly attached to said main spindle, and a stator which is rigidly attached to the lower end of said cylindrical spindle casing, with no additional journal bearings between said motor rotor and stator, said working chamber communicating with at least the lower of said bearing assemblies whereby at least the latter bearing assembly is lubricated by hudraulic fluid from the motor.

7. A centrifuge according to claim 6, in which a rotary seal is disposed between the spindle and the inner periphery of the cylindrical casing at a portion between the upper and lower bearing assemblies, the annular chamber so formed between the rotary seal and the upper bearing assembly being drained to atmosphere.

8. A hydraulically driven basket centrifuge as claimed in claim 6, said hydraulic motor being carried outboard of the lower bearing assembly on said spindle.

9. A cartridge unit for rotatably mounting and driving the basket of a hydraulically driven basket centrifuge, the cartridge unit comprising a spindle which is adapted to support said basket from below, a hydraulic motor adapted to rotate said main spindle about a vertical axis, a cylindrical spindle casing, means journalling said main spindle for rotation within said spindle casing about a vertical axis, said means including at least two bearing assemblies disposed independently of said hydraulic motor at upper and lower positions on the spindle, respectively, the hydraulic motor including a rotor which is disposed within a working chamber defined by said cylindrical spindle casing and which is rigidly attached to said main spindle, and a stator which is rigidly attached to the lower end of said cylindrical spindle casing, with no additional journal bearings between said motor rotor and stator, said working chamber communicating with at least the lower of said bearing assemblies whereby at least the latter bearing assembly is lubricated by hydraulic fluid from the motor.

* * * * *